US010246297B2

(12) United States Patent
Ou et al.

(10) Patent No.: US 10,246,297 B2
(45) Date of Patent: Apr. 2, 2019

(54) RUST REMOVING DEVICE FOR ELEVATOR GUIDE RAIL

(71) Applicant: Otis Elevator Company, Farmington, CT (US)

(72) Inventors: YuHang Ou, Hangzhou (CN); ChunYan Yu, Hangzhou (CN); WeiHua Yuan, Hangzhou (CN); Jing Nie, Hangzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 30 days.

(21) Appl. No.: 15/108,883

(22) PCT Filed: Dec. 29, 2014

(86) PCT No.: PCT/US2014/072521

§ 371 (c)(1),
(2) Date: Jun. 29, 2016

(87) PCT Pub. No.: WO2015/103119

PCT Pub. Date: Jul. 9, 2015

(65) Prior Publication Data

US 2016/0325967 A1 Nov. 10, 2016

(30) Foreign Application Priority Data

Dec. 31, 2013 (CN) ..... 2013 1 0755544

(51) Int. Cl.

| | |
|---|---|
| ***B66B 7/12*** | (2006.01) |
| ***B24B 19/00*** | (2006.01) |
| *B66B 7/04* | (2006.01) |

(52) U.S. Cl.

CPC ..... *B66B 7/1292* (2013.01); *B24B 19/004* (2013.01); *B66B 7/047* (2013.01)

(58) Field of Classification Search

None

See application file for complete search history.

(56) References Cited

U.S. PATENT DOCUMENTS

| | | | | |
|---|---|---|---|---|
| 4,216,846 | A | 8/1980 | Wheeler | |
| 6,719,620 | B1 * | 4/2004 | Panfili | B24D 15/023 451/515 |
| 2010/0257689 | A1 * | 10/2010 | Hyang-Seok | B66B 31/003 15/256.5 |

FOREIGN PATENT DOCUMENTS

| | | |
|---|---|---|
| CN | 101318605 A | 12/2008 |
| CN | 101863404 A | 10/2010 |

(Continued)

OTHER PUBLICATIONS

English Machine Trans of JP 2000 238975.*

(Continued)

*Primary Examiner* — Joseph J Hail
*Assistant Examiner* — Brian D Keller
(74) *Attorney, Agent, or Firm* — Cantor Colburn LLP

(57) ABSTRACT

The present invention relates to a rust removing device for an elevator guide rail and aims at solving a problem of great time and labor taken and insufficient rust removal due to that rust of existing guide rail is removed manually. The rust removing device comprises: a support; a rust removal rack, mounted on the support and covering guide rail; and a rust removal material, arranged on a U-shaped inner wall of the rust removal rack and fitted with a surface of the guide rail. The rust removing device of the present invention has advantages that the rust of the guide rail is removed automatically instead of being removed manually, featured by a high rust removing speed, energy saving, simple maintenance, and less influence on users due to long-time service stop because of rust removal.

7 Claims, 2 Drawing Sheets

(56) References Cited

FOREIGN PATENT DOCUMENTS

| | | | | |
|---|---|---|---|---|
| CN | 201598083 | U | | 10/2010 |
| CN | 202015989 | U | | 10/2011 |
| CN | 202029014 | U | | 11/2011 |
| CN | 102730514 | A | | 10/2012 |
| JP | H04277185 | A | | 10/1992 |
| JP | H09301653 | | * | 11/1997 |
| JP | 2000238975 | A | | 9/2000 |
| JP | 2001199654 | A | | 7/2001 |
| JP | 2010168182 | A | | 8/2010 |
| TW | 355539 | U | | 4/1999 |

OTHER PUBLICATIONS

Eng Mach Trans of JPH09301653.*
PCT International Search Report for application PCT/US2014/072521 dated Sep. 2015, 4 pages.
Written Opinion for application PCT/US2014/072521 dated Sep. 2015, 4 pages.
CN First Office Action and English Translation; Application No. CN 201310755544.4; dated Oct. 10, 2015; 17 pages.
CN Second Office Action and English Translation; Application No. CN 201310755544.4; dated Apr. 18, 2016; 16 pages.
CN Third Office Action and English Translation; Application No. CN 201310755544.4; dated Jul. 25, 2016; 7 pages.

* cited by examiner

RUST REMOVING DEVICE FOR ELEVATOR GUIDE RAIL

TECHNICAL FIELD

The present invention relates to an elevator device, and more particularly to a rust removing device for an elevator guide rail, which has a simple structure and a high rust removing speed.

RELATED ART

For an elevator configured with a sliding guide shoe, in order to relieve the force of friction on the guide shoe, the guide shoe is mounted with an oil cup for storing lubricant oil. The lubricant oil is used for lubricating guide rail at any time, and meanwhile, and enables a working surface of the guide rail to be isolated from the open air under the protection of the lubricant oil, thereby protecting the guide rail from generating rust. For an elevator configured with a roller guide shoe, the roller guide shoe is made of nylon and rubber. If the guide rail also uses lubricant oil to avoid being rusted, the roller is immersed within the lubricant oil for a long time, and the lubricant oil corrodes the nylon and rubber of the roller. Therefore, for the guide rail configured with the roller guide shoe, the working surface of the guide rail is directly exposed to the open air for a long time, and as a result, it may generate rust. The rust and powders may be adhered to the guide rail, which possibly affect user's comfortable experience when taking the elevator and the operating performance of the safety clamp. However, currently, the rust is removed manually by the maintenance staff by using abrasive papers and cotton gauzes, without any automatic removing tool. As a result, the rust removing process costs a lot of working hours, and the rust cannot be removed completely, which consumes a lot of time and labor work. As disclosed in Chinese Utility Model Patent NO. 200920193143.3, entitled Roller Guide Shoe, rollers and a roller axis are assembled by a set of conical rolling bearings. The rollers have U-shaped slots, and surfaces of the U-shaped slots are made of polyurethane material. The U-shaped slot of the roller is fitted with the working surface of the guide rail. In the above patent, the roller guide shoe is adopted, and the roller surface is covered by polyurethane material, so that it unavoidably has the defects that the rollers are immersed within the lubricant oil for a long time, and the lubricant oil may corrode the surface materials of the rollers. For the guide rail configured with the roller guide shoe, the working surface of the guide rail is directly exposed to the open air for a long time, and may generate rust, which requests the maintenance staff to remove the rusts, thereby resulting in the problem that it consumes a lot of time and labor power, but still cannot remove the rust completely and clearly.

SUMMARY

In order to solve the problems in the prior art that the rust removal process on the guide rail is finished manually and it consumes a lot of time and labor power and the rust still cannot be removed completely and clearly, the present invention provides a rust removing device for an elevator guide rail, which has a simple structure and a high rust removing speed.

In order to solve the above technical problems, the present invention provides the following technical solutions. Specifically, the present invention provides a rust removing device for an elevator guide rail, which includes a support, a rust removal rack mounted on the support and covering a guide rail, and a rust removal layer disposed on an inner wall of the rust removal rack and fitted with a surface of the guide rail. In the present invention, the rust removing device is disposed on a lift car of an elevator, to replace the manual rust removal process in the prior art, which can remove the rust quickly, save the manual power, simplify the maintenance process, and relieve the influence on users due to long-time service stop because of rust removal. The guide rail extends into a concave surface of the rust removal rack, but there is still a space between the guide rail and the rust removal rack, for mounting the rust removal layer. The rust removal layer is closely fitted with three surfaces of the guide rail. When the lift car moves, the rust removing device moves along with it, and meanwhile the rust removing device removes the rust on the guide rail.

As a preferred solution, the rust removal rack has a U-shaped structure. A top end of the rust removal rack is disposed with fastening platforms at two sides respectively. The rust removal layer protrudes out of the top end of the rust removal rack, and is placed on the fastening platforms, and then is tightly pressed onto the fastening platforms by hold-down plates disposed on the fastening platforms. Then, the hold-down plates are fixed on the fastening platforms by fastening bolts. A bottom end of the rust removal rack is disposed with L-shaped fastening plates at two sides thereof respectively. The rust removal layer protrudes out of the bottom end of the rust removal rack and is attached to the fastening plates, and then is pressed onto the fastening plates by hold-down plates disposed on the fastening plates. The hold-down plates are fixed on the fastening plates by fastening bolts. The rust removal rack is designed with a U-shaped structure, to be matched with the structure of the guide rail. This solution is used for fixing the rust removal layer, that is, the top end and the bottom end of the rust removal layer respectively protrude out of the rust removal rack, and then are fixed on the fastening platforms and the fastening plates, so that it is easy for mounting and dismounting the rust removal layer.

As a preferred solution, a shoe lining is further disposed between the rust removal rack and the rust removal layer. The shoe lining guarantees that the guide rail does not directly contact the rust removal rack, when the rust removal layer functions for polishing, thereby protecting the rust removal rack. The shoe lining is connected with a U-shaped inner concave surface of the rust removal rack by means of using bolts, welding, riveting, adhering, or clipping.

As a preferred solution, the shoe lining is made of a metal material or a non-metal material. If the shoe lining is made of a metal material, the shoe lining is made of nylon, plastic, or felt. The metal material of the shoe lining may be different from that of the guide rail, or may be the same as that of the guide rail but having different rigidities.

As a preferred solution, the rust removal layer is made of an abrasive paper, a cotton gauze, an oilstone, an abrasive disc, or a cutting disc.

As a preferred solution, the rust removal rack is connected with the support by a hold-down mechanism. The hold-down mechanism includes a fixing rack fixed on the support. The rust removal rack is fixed on a front end of the fixing rack. A spring is disposed within the fixing rack. A first spring seat is disposed at a bottom part of the fixing rack, and a second spring seat is disposed at a back part of the rust removal rack. One end of the spring presses against the first spring seat, and the other end of the spring presses against the second spring seat. The hold-down mechanism is disposed at a back part of the rust removal rack, so that a pre-tightening force is generated between the rust removal layer within the rust removal rack and the guide rail, to ensure that the rust removal layer sufficiently contacts the guide rail while the lift car moves.

As a preferred solution, an adjusting mechanism is further disposed between the spring and the fixing rack. The adjusting mechanism includes a bolt chair disposed at a bottom part of the fixing rack and having an adjusting bolt mounted thereon. The adjusting bolt passes through the fixing rack, and then a front end of the adjusting bolt is connected to a back surface of the first spring seat. By adjusting the adjusting bolt, a pre-tightening force of the spring is adjusted, thereby changing a pressure generated by the hold-down mechanism against the rust removal rack.

As a preferred solution, bumper blocks are further disposed between the fixing rack and two sides of the rust removal rack. The bumper block is rubber. The guide rail has a certain deviation in a perpendicular direction. The bumper blocks are configured to prevent a force of friction between the rust removing device and the guide rail from getting aggravated, thereby shortening the service life time of the rust removal layer. The bumper blocks are connected with the fixing rack by means of using bolts, riveting, welding, adhering, or clipping.

As a preferred solution, the rust removing device is mounted on a lift car. Specifically, the rust removing device is mounted on a top part of a roller guide shoe, on a top part of an upper guide shoe, and on a bottom part of a lower guide shoe of the lift car. Alternatively, the rust removing device is mounted on a counterpoise. Specifically, the rust removing device is mounted on a top part of an upper beam of the counterpoise, on a bottom part of a lower beam of the counterpoise, on a top part of an upper roller guide shoe of the counterpoise, or on a bottom part of a lower roller guide shoe of the counterpoise. The rust removing device is preferably mounted on the above places, but it still can be mounted on a top part of the upper beam, an inner part of the upper beam, between the upper beam and the top part of the lift car, on a bottom part of a lower tray of the lift car, or on a bottom part of the lower guide shoe.

As a preferred solution, the rust removing device is mounted on the counterpoise. Specifically, the rust removing device is mounted on a top part of an upper beam of the counterpoise, a bottom part of a lower beam of the counterpoise, a top part of an upper roller guide shoe of the counterpoise, or a bottom part of a lower roller guide shoe of the counterpoise.

Therefore, the present invention has advantages that it can automatically remove the rust on the guide rail, to replace the manual rust removing process in the prior art, featured by a high rust removing speed, energy saving, simple maintenance, and less influence on users due to long-time service stop because of rust removal.

Explanation of numerals: 1—Support, 2—Fixing rack, 3—Rust removal rack, 4—Shoe lining, 5—Rust removal layer, 6—Bolt chair, 7—Adjusting bolt, 8—First spring seat, 9—Second spring seat, 10—Spring, 11—Bumper block, 12—Fastening platform, 13—Hold-down plate, and 14—Fastening plate.

DETAILED DESCRIPTION

The technical solutions of the present invention are further described ingrate detail through the following examples with reference to the accompanying drawings.

EXAMPLE

Figure 1:
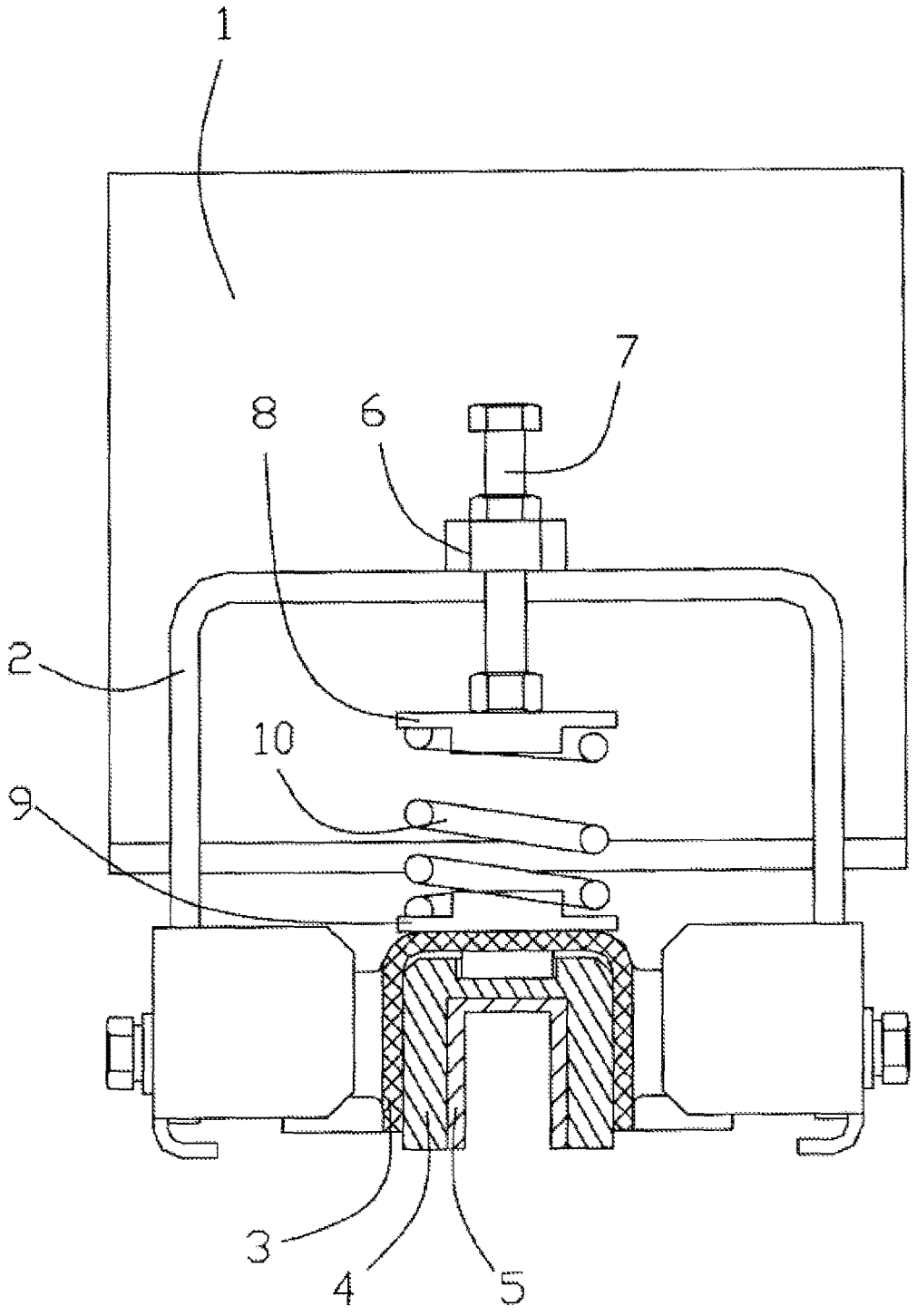
FIG. 1 is a cross-sectional top view of a structure of the present invention.
Figure 2:
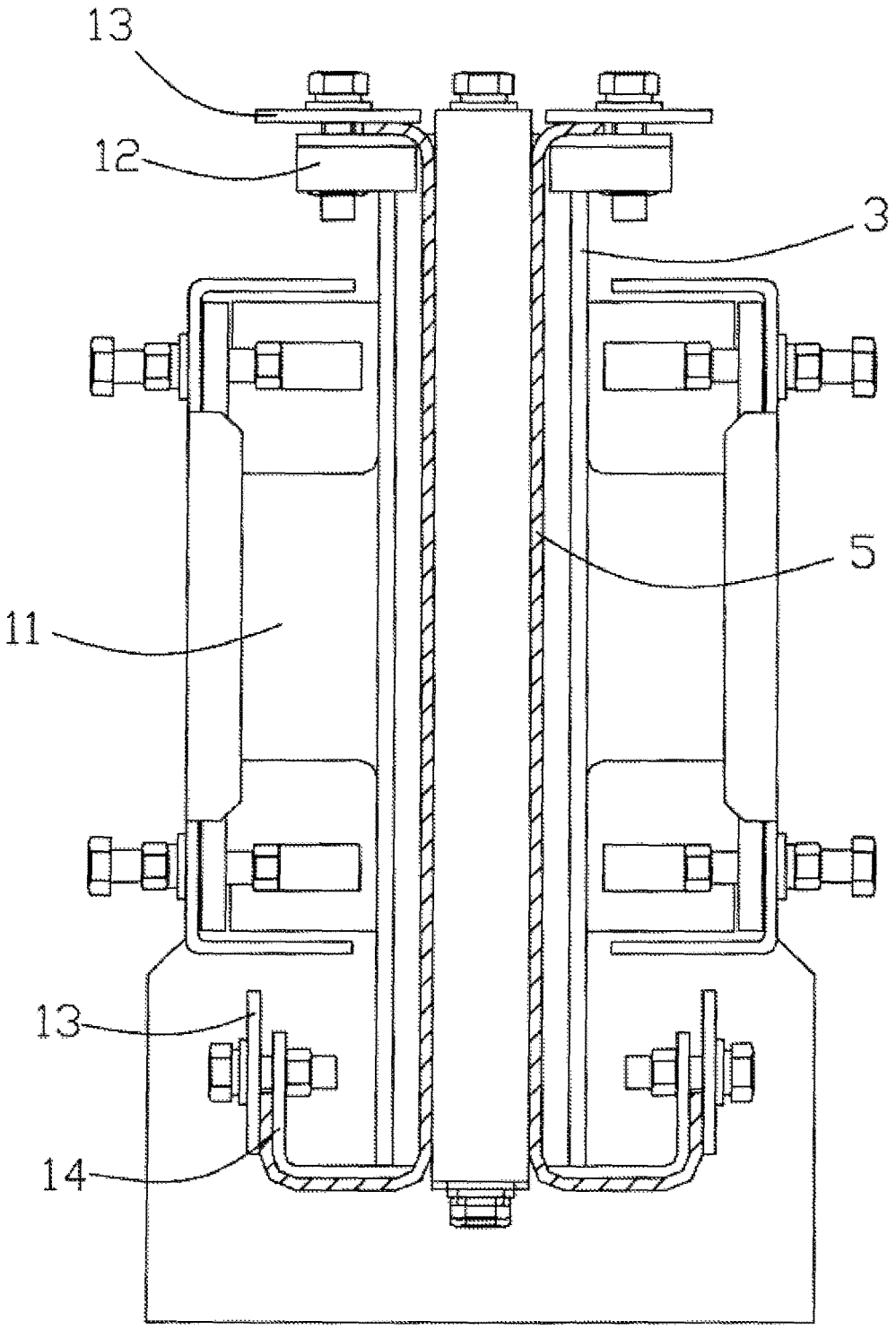
FIG. 2 is a schematic structural view of a front side of the present invention.

In the example, the present invention provides a rust removing device for an elevator guide rail. As shown in FIGS. 1 and 2, the rust removing device includes a support 1 and a U-shaped rust removal rack 3. The rust removal rack is connected to the support by a hold-down mechanism. The hold-down mechanism includes a fixing rack 2 having a U-shaped cross section. The rust removal rack is fixed between two sides at a front end of the fixing rack by using bolts. Bumper blocks 11 are further disposed between the fixing rack and two sides of the rust removal rack, which are made of rubber. The hold-down mechanism further includes a spring 10 disposed within the fixing rack. One end of the spring is disposed with a first spring seat 8 located on a bottom surface of the fixing rack. The other end of the spring is disposed with a second spring seat 9 located on a back part of the rust removal rack.

An adjusting mechanism is further disposed between the spring and the fixing rack, which includes a bolt chair 6 disposed at a bottom part of the fixing rack and having an adjusting bolt 7 mounted thereon. The adjusting bolt passes through the fixing rack, and then a front end of the adjusting bolt is connected to a back surface of the first spring seat 8.

The rust removal rack has a U-shaped cross section. A layer of shoe mat 4 is disposed on the U-shaped inner concave surface, and has the rust removal layer 5 being configured thereon. A top end of the rust removal rack is disposed with fastening platforms 12 on two sides thereof respectively. The rust removal layer protrudes out of the top end of the rust removal rack, and is placed on the fastening platforms, and then is tightly pressed onto the fastening platforms by hold-down plates 13 disposed on the fastening platforms. Then, the hold-down plates are fixed on the fastening platforms by fastening bolts. A bottom end of the rust removal rack is disposed with L-shaped fastening plates 14 at two sides thereof respectively. The rust removal layer protrudes out of the bottom end of the rust removal rack and is attached to the fastening plates, and then is pressed onto the fastening plates by hold-down plates 13 disposed on the fastening plates. The hold-down plates are fixed on the fastening plates by fastening bolts. The rust removal layer is made of an abrasive paper, which may be further made of a cotton gauze, an oilstone, an abrasive disc, or a cutting disc, besides abrasive paper. The shoe mat is made of a metal material, and may also be made of a non-metal material, such as nylon, plastic, or felt.

In the example, the rust removing device is mounted on a top part of a roller guide shoe of a lift car, or may be mounted at other positions, for example, on a top part of an upper guide shoe, on a bottom part of a lower guide shoe of the lift car. In addition, the rust removing device is mounted on a counterpoise, for example, on a top part of an upper beam of the counterpoise, on a bottom part of a lower beam of the counterpoise, on a top part of an upper roller guide shoe of the counterpoise, or on a bottom part of a lower roller guide shoe of the counterpoise.

What are described in the specification are preferred examples of the present invention, and the examples are only used for describing the technical solution of the present invention instead of limiting the present invention. Technical solutions that can be made by persons skilled in the art according to the present invention through logic analysis, ratiocination or limited experiment should all fall within the scope of the present invention.

Although the present invention adopts terms such as support, fixing rack, rust removal rack, shoe lining, or rust removal layer, it is also possible for the present invention to use other terms. The above terms are merely intended to describe and demonstrate the essence of the present invention easily and conveniently, which cannot be considered as an additional restriction on the present invention.

The invention claimed is:

1. A rust removing device for an elevator guide rail, comprising:

a support;

a fixing rack, fixed on the support, wherein the fixing rack comprises a U-shaped cross section having at least a first end;

a rust removal rack, fixed on the first end of the fixing rack;

non-metallic shoe lining, disposed on a U-shaped inner concave surface of the rust removal rack; and a rust removal layer, disposed on the non-metallic shoe lining, and fitted with a surface of the guide rail, wherein the rust removal layer is made of at least oilstone, the non-metallic shoe lining comprising a U-shaped structure that is disposed between the rust removal rack and the rust removal layer;

wherein the rust removal rack comprises a U-shaped structure having at least a first end, a second end, a first side, and a second side;

wherein the first end of the U-shaped structure of the rust removal rack is disposed with fastening platforms at the first and second side respectively, the rust removal layer includes first protrusion portions that protrude out of the first end of the rust removal rack, wherein the first protrusion portions of the removal layer are placed on the fastening platforms and then pressed onto the fastening platforms by hold-down plates disposed on the fastening platforms, wherein the hold-down plates disposed on the fastening platforms are fixed to the fastening platforms by fastening bolts;

wherein the second end of the U-shaped structure of the rust removal rack is disposed with L-shaped fastening plates at the first and second side respectively, the rust removal layer includes second protrusion portions that protrude out of the second end of the rust removal rack, wherein the second protrusion portions of the rust removal layer are attached to the L-shaped fastening plates and then pressed onto the L-shaped fastening plates by hold-down plates disposed on the L-shaped fastening plates, wherein the hold-down plates disposed on the L-shaped fastening plates are fixed to the L-shaped fastening plates by fastening bolts.

2. The rust removing device for the elevator guide rail according to claim 1, wherein the shoe lining is made of nylon, plastic, or felt.

3. The rust removing device for the elevator guide rail according to claim 1, wherein a spring is disposed within the fixing rack; a first spring seat is disposed at a bottom part of the fixing rack; a second spring seat is disposed at a back part of the rust removal rack; one end of the spring presses against the first spring seat, and the other end of the spring presses against the second spring seat.

4. The rust removing device for the elevator guide rail according to claim 3, wherein an adjusting mechanism is further disposed between the spring and the fixing rack; the adjusting mechanism comprises: a bolt chair, disposed at a bottom part of the fixing rack and having an adjusting bolt mounted thereon; the adjusting bolt passes through the fixing rack, and then a front end of the adjusting bolt is connected to a back surface of the first spring seat.

5. The rust removing device for the elevator guide rail according to claim 3, wherein bumper blocks are further disposed between the fixing rack and two sides of the rust removal rack respectively, and the bumper blocks are rubber.

6. The rust removing device for the elevator guide rail according to claim 1, wherein the rust removing device is mounted on a lift car, and specifically the rust removing device is mounted on a top part of a roller guide shoe, on a top part of an upper guide shoe, and on a bottom part of a lower guide shoe of the lift car; or the rust removing device is mounted on a counterpoise, and specifically the rust removing device is mounted on a top part of an upper beam of the counterpoise, on a bottom part of a lower beam of the counterpoise, on a top part of an upper roller guide shoe of the counterpoise, or on a bottom part of a lower roller guide shoe of the counterpoise.

7. The rust removing device for the elevator guide rail according to claim 1, wherein the rust removing device is mounted on a counterpoise, mounted on a top part of an upper beam of the counterpoise, on a bottom part of a lower beam of the counterpoise, on a top part of an upper roller guide shoe of the counterpoise, or on a bottom part of a lower roller guide shoe of the counterpoise.

* * * * *